US007601472B2

(12) United States Patent
Kittle

(10) Patent No.: US 7,601,472 B2
(45) Date of Patent: Oct. 13, 2009

(54) TONER/DEVELOPER COMPOSITIONS

(75) Inventor: Kevin Jeffrey Kittle, Co. Durham (GB)

(73) Assignee: Akzo Nobel Coatings International B.V., Arnhem (NL)

( * ) Notice: Subject to any disclaimer, the term of this patent is extended or adjusted under 35 U.S.C. 154(b) by 349 days.

(21) Appl. No.: 10/525,678

(22) PCT Filed: Aug. 1, 2003

(86) PCT No.: PCT/GB03/03381

§ 371 (c)(1),
(2), (4) Date: Feb. 1, 2005

(87) PCT Pub. No.: WO2004/013703

PCT Pub. Date: Feb. 12, 2004

(65) Prior Publication Data

US 2005/0175916 A1 Aug. 11, 2005

(30) Foreign Application Priority Data

Aug. 1, 2002 (GB) ..... 0217899.4

(51) Int. Cl.
*G03G 9/00* (2006.01)

(52) U.S. Cl. ..... 430/108.6; 430/108.7

(58) Field of Classification Search ..... 430/106.1, 430/108.6, 108.7
See application file for complete search history.

(56) References Cited

U.S. PATENT DOCUMENTS

| | | | | |
|---|---|---|---|---|
| 3,607,337 | A | 9/1971 | Eisenmenger et al. | 106/288 Q |
| 3,816,154 | A | 6/1974 | Baldyga et al. | 106/308 O |
| 5,501,934 | A * | 3/1996 | Sukata et al. | 430/108.1 |
| 5,547,796 | A | 8/1996 | Kohtaki et al. | 430/106.6 |
| 5,607,806 | A * | 3/1997 | Kanbayashi et al. | 430/108.3 |
| 5,874,019 | A * | 2/1999 | Uchida et al. | 252/62.59 |
| 5,885,743 | A | 3/1999 | Takayanagi et al. | 430/110 |
| 6,531,524 | B2 * | 3/2003 | Ring et al. | 523/205 |
| 2001/0005735 | A1 * | 6/2001 | Ring et al. | 524/599 |
| 2002/0169234 | A1 * | 11/2002 | Ring et al. | 523/205 |
| 2002/0192584 | A1 * | 12/2002 | Hayashi et al. | 430/106.1 |

FOREIGN PATENT DOCUMENTS

| | | | |
|---|---|---|---|
| DE | 287 392 | A7 | 2/1991 |
| EP | 0 601 235 | A1 | 6/1994 |
| GB | 1 373 220 | | 11/1974 |
| GB | 1 528 110 | | 10/1978 |
| GB | 2074745 | A | 11/1981 |
| JP | 58 091463 | | 5/1983 |
| JP | 2002-029730 | | 4/2002 |
| WO | WO 97/08250 | | 3/1997 |

OTHER PUBLICATIONS

International Preliminary Examination Report No. PCT/GB03/03381, dated Mar. 18, 2004.
International Search Report No. PCT/GB 03/03381, dated Dec. 2, 2003.
Derwent Abstract 008711875, abstracting DD 287 392.
Patent Abstracts of Japan abstracting JP 2002-029730.
Computer Translation of JP 2002-029730.

* cited by examiner

*Primary Examiner*—John L Goodrow
(74) *Attorney, Agent, or Firm*—Kenyon & Kenyon LLP

(57) ABSTRACT

Toner compositions have a post-blended particulate additive which comprises aluminum oxide and aluminum hydroxide with, optionally, a third component such as silica or a wax, which is a tribo-charging additive which, upon tribo-charging of the toner particles, shifts the charge distribution in either the positive or negative direction. As well as providing toner compositions having adequate fluidity, the use of pre-extrusion charge-control additives can be avoided. There are also advantages, for example, in terms of charge distribution characteristics, stability of charge distribution, and avoidance of matting effects. Developer compositions are formed by admixture with suitable carrier particles.

41 Claims, No Drawings

TONER/DEVELOPER COMPOSITIONS

This application is the national phase of International Patent Application No. PCT/GB2003/003381, filed on Aug. 1, 2003, and which claims priority of Great Britain Patent Application No. 0217899.4, filed Aug. 1, 2002.

This invention relates to toner compositions and developer compositions for use in electrostatic copying and printing, such as xerography, electrophotography, electrography and digital printing. The invention is also applicable to magnetography and ionography.

The particle size distribution of a toner composition (excluding any post-additives) is typically such that $d(v)_{90}$ for the composition is ≦15 microns, with a mean particle size of the order of 5 to 8 microns. Ultrafine particles generated in milling of the composition are customarily removed, to aid toner mobility and obtain adequate print definition, but the remaining particles are still very fine and will tend to agglomerate and exhibit poor fluidity, with consequential detrimental effects on the copying or printing process. For that reason, it has become common practice in the art to incorporate a so-called post-additive with the base toner composition, in order to provide adequate fluidity. Examples of such fluidity-enhancing post-additives include aluminium oxide, titanium dioxide and, especially, silica, more particularly hydrophobic silica.

At concentrations of 2-3% by weight, hydrophobic silica is generally effective as a post-additive in imparting satisfactory fluidity to toner compositions, but a number of problems have been observed, especially at the relatively high concentrations that can be necessary to impart adequate fluidity in the case of certain toner systems, especially those of relatively fine particle size. In particular, it has been found that increasing concentrations of hydrophobic silica can have a detrimental effect on the charge distribution generated in the toner from tribostatic interaction, both in causing undesirable broadening of the distribution curve and in producing a distribution which is unstable and exhibits charge relaxation over time. The latter effect can lead to particular difficulties when a developer composition incorporating the toner, after charge relaxation to a low-charge condition, is replenished with fresh toner with the original high-charge distribution.

Similar difficulties may be encountered when using aluminium oxide as fluidity-enhancing post-additive. More particularly, the tribo-charging effect of aluminium oxide tends to be very sensitive to concentration variation up to concentrations of about 1% by weight and, at higher concentrations, aluminium oxide tends to cause electrostatic discharge and may also result in an undesirable seedy or grainy appearance in the fused toner film.

It is an object of the present invention to alleviate the problems outlined above.

Toner technology relies on toners having a monopolar charge, that is, having a negative or positive charge, and a further aspect of the invention concerns control of the charge distribution of the tribostatically charged toner. Such control is conventionally achieved by means of so-called charge control agents, for example, metal azo complexes, which are incorporated with the toner resin and pigment before the extrusion or other homogenisation process used in manufacture of the toner composition. Although the use of such pre-extrusion charge control agents provides generally satisfactory results, it would be advantageous in a number of respects to be able to achieve charge control without the use of pre-extrusion agents.

The present invention provides a toner composition having a post-blended particulate additive which comprises aluminium oxide and aluminium hydroxide.

Advantageously, the post-blended particulate additive also includes, as a third component, a tribo-charging additive which, upon tribo-charging of the toner particles, shifts the charge distribution in either the positive or negative direction as compared with the charge distribution in the absence of the additive.

In addition to providing toner compositions of adequate fluidity, the use of a post-blended additive in toner compositions in accordance with the invention offers a number of advantages:

1) Especially in the case in which the post-blended particulate additive includes a tribo-charging third component as specified above, charge control is achievable solely by adjustment of the proportions of the components of the post-additive according to the invention. No pre-extrusion charge-control additive is needed although, in the case of a two-component additive according to the invention, it is preferable for the toner composition to include such a material, typically a charge control agent, a tribo-modified resin, a wax material, or a pigment. Further, there is in general no need for a secondary charge-control post-additive.
2) The possibility of relying solely on a post-additive approach for achieving charge control facilitates matching of toner compositions to particular end uses.
3) The undesirable effects on charge distribution and stability of distribution, observed hitherto at increasing concentrations of, for example, silica as post-additive, and the undesirable concentration dependence of tribostatic charge distribution observed especially at relatively low concentrations of aluminium oxide, are substantially reduced or even eliminated.
4) The surface finish of the fused toner on the substrate is not adversely affected by the matting effect that has been observed when, for example, silica or aluminium oxide has been used as post-additive alone. This feature may be advantageous in non-contact fusing, where high gloss is required without the use of a heated roller. Also, in printers in which a heated roller is used, it should be possible to operate at lower fusing temperatures thereby causing less drying-out of a paper substrate.
5) In contrast with the conventional use of, for example, a silica or aluminium oxide post-additive alone, the carrier particles in a developer composition incorporating the base toner composition and a post-additive combination according to the invention remain substantially free of deposited additive (as demonstrated, for example, by X-ray microanalysis).

A tribo-charging additive used as third component is advantageously a material which also functions as a fluidity-assisting additive for the toner particles.

The tribo-charging additive is advantageously a silica, preferably a hydrophobic silica, but may instead be another material fulfilling the specified tribo-charging function and compatible for use in toner compositions, for example, a wax. A wax-coated silica may be used.

The term "silica" as used herein includes materials obtained by pyrogenic and, preferably, wet processes leading to precipitated silicas or silica gels, as well as, in principle, mixed metal-silicon oxides and naturally occurring materials such as, for example, diatomaceous earth. Silicas for use according to the invention will in general have amorphous structure. The term "silica" includes silicic acid materials. Silicates also come into consideration.

A preferred material comprises micronised silica gel.

The term "wax" as used herein includes:

i) Natural animal waxes (for example, beeswax, lanolin);

ii) Natural vegetable waxes (for example, carnauba wax);

iii) Natural petroleum waxes (for example, paraffin wax, microcrystalline wax);

iv) Synthetic waxes (for example, ethylenic polymers and polyol ether-esters).

Mineral waxes other than petroleum waxes may also come into consideration.

An important group of waxes for use in accordance with the invention comprises esters of long-chain aliphatic alcohols (typically $C_{16}$ and above) with long-chain fatty acids (typically $C_{16}$ and above). Such esters and acids are preferably straight-chain compounds, and may be saturated or unsaturated. Examples of acids which may be used include stearic acid, palmitic acid and oleic acid and mixtures of two or more thereof.

Waxes derived from long-chain aliphatic compounds as described above may include hydrocarbons.

In addition to esters of the long-chain acids as described above there may be mentioned salts such as, for example, aluminium stearate.

Wax-coated silicas suitable for use in accordance with the invention include commercially available materials such as, for example, GASIL 937 ex Crosfield (a silica gel coated with microcrystalline paraffin wax) and OK 607 ex Degussa (a similar material with a coating which also includes a short-chain [$C_6$] saturated amine or alkyl ammonium component).

Coating of the silica material may be effected by methods known in the art, for example, by co-milling of the silica with a solid wax material, or by admixing the silica material with a wax material dissolved in a suitable solvent which is then evaporated.

The amount of wax coated onto the silica may, for example, be in the range of from 2 to 10% by weight, based on the weight of the silica.

Further information concerning wax-coated silicas which may be used in accordance with the invention may be found in U.S. Pat. Nos. 3,607,337 and 3,816,154, and in WO 97/08250.

The term "hydrophobic silica" denotes a silica of which the surface has been modified by the introduction of silyl groups, for example, polydimethylsiloxane, bonded to the surface. Such materials are commercially available, for example, HDK H3004 from Wacker-Chemie.

A hydrophobic silica having surface-bonded siloxane groups will tend to shift the charge distribution of the toner particles, upon tribo-charging, in the negative direction. If amino and/or ammonium groups are present in addition to siloxane groups, the resulting hydrophobic silica will tend to shift the charge distribution of the toner particles in the positive direction upon tribo-charging.

The particle size of each post-blended additive component may be in the range of from 0.01 to 10 microns, and should as a generality be below that of the toner particles themselves. By way of exception, however, larger particles can in principle be used in the case of tribo-charging additive materials such as waxes that will melt under the application conditions of, for example, an electrostatic printing or copying process.

Typically, the particle size of the aluminium oxide will be $\leqq$0.2 microns and the particle size of the aluminium hydroxide will be in the range of from 0.9 to 1.3 microns.

The total amount of the post-blended additive may be in the range of from 0.1 to 25% by weight, based on the weight of the toner composition without the additive, advantageously from 1 to 15% by weight, preferably $\leqq$10% by weight, for example 1 to 5%, more especially 2 to 4%. As a generality, the smaller the particle size of the particulate toner composition, the greater the amount of the post-blended additive that will be needed in order to ensure satisfactory fluidity.

It is believed that any of the main structural types of aluminium oxide and aluminium hydroxide (and/or aluminium oxyhydroxide) may be used, that is to say:

$\alpha$-$Al_2O_3$ Corundum $\alpha$-AlO(OH) Diaspore $\alpha$-$Al(OH)_3$ Bayerite $\gamma$-$Al_2O_3$ $\gamma$-AlO(OH) Boehmite $\gamma$-$Al(OH)_3$ Gibbsite.

Preference may be given to $\gamma$-structural types.

The ratio by weight of aluminium hydroxide to aluminium oxide in the post-blended additive may be in the range of from 1:99 to 99:1, advantageously from 50:50 to 99:1, preferably from 50:50 to 80:20 or 90:10.

A tribo-charging additive used as third component may constitute from 1 to 99% by weight of the total post-blended additive, preferably from 1 to 70% by weight, for example, from 15 to 25% by weight. By way of example, the post-blended additive may comprise 52% by weight of aluminium hydroxide, 28% by weight of aluminium oxide and 20% by weight of a hydrophobic silica tribo-additive.

In general, it will be found that the following relationships apply:

the higher the aluminium oxide concentration in the post-additive combination of the invention, the greater will be the fluidity of the toner composition the higher the concentration of aluminium hydroxide in the post-additive combination, the less sensitive to concentration will be the charging effect of a tribo-charging additive used as third component, especially silica the higher the concentration of the total post-additive combination, the better will be the fluidity of the toner composition Although any component of the post-blended additive, or mixed sub-combination of components, may in principle be blended separately with the toner composition, pre-mixing of additives is generally preferred. Also, in the case in which a tribo-charging additive is used as a third component in addition to the aluminium oxide and aluminium hydroxide, it is generally advantageous to pre-mix the aluminium oxide and aluminium hydroxide before mixing-in the tribo-charging additive.

Pre-mixing of the additive components in the case where a third (tribo-charging) component is used has the advantage of lessening the (otherwise) relatively high charge-to-concentration dependence of the third component. As a result, relatively high levels of a three-component additive can be incorporated with a toner composition without a correspondingly large increase in charge being generated. This is advantageous where high levels of post-blended additive are required for fluidity purposes, and furthermore is advantageous in manufacturing, by making the toner charge less susceptible to small variations in post-blended additive concentration.

The post-blended additive, or any component thereof, may be incorporated with the toner composition by any available post-blending method, for example:

(a) injection at the mill, with the (extruded) chip and additive being fed into the mill simultaneously;

(b) introduction at the stage of sieving after milling; and (c) post-production blending in a "tumbler" or other suitable mixing device.

The toner composition may comprise a resin, a colouring agent, optionally a charge-control agent, and optionally a wax.

The proportion of resin in a toner composition of the invention may be in the range of from 40, 50, 60, 70 or 80 to 99% by weight, based on the total weight of the composition without post-blended additive.

The proportion of colouring agent in a toner composition of the invention may be in the range of from 1 to 60% by weight, based on the total weight of the composition without post-blended additive.

The proportion of charge-control agent incorporated in the toner particles may be in the range of from 0 to 10% by weight, based on the total weight of the composition without post-blended additive.

Suitable resins include polyester resins and styrene copolymers. Mixtures of resins may be used.

Suitable polyester resins are, for example, polycondensation products of difunctional organic acids with di-functional alcohols or aromatic dihydroxy compounds.

Examples of difunctional acids which may be used include maleic acid, fumaric acid, terephthalic acid, and isophthalic acid.

Examples of difunctional alcohols which may be used include ethylene glycol and triethylene glycol, and examples of aromatic dihydroxy compounds which may be used include Bisphenol A and alkoxylated bisphenols, for example, propoxylated bisphenol.

Toner compositions based on polyester resins are described, for example, in GB-A-1 373 220.

Examples of suitable styrene copolymers include styrene acrylate polymers, for example, styrene/2-ethylhexylacrylate polymers, and styrene methacrylate polymers, for example, styrene/n-butyl methacrylate polymers. Styrene-acrylics are described, for example, in U.S. Pat. No. 5,885,743.

Further examples of styrene copolymers include styrene/butadiene, styrene/maleic acid and styrene/itaconic acid polymers.

Other resins suitable for use in toner compositions may also be employed.

The colouring agent is typically a pigment or mixture of pigments, although dyestuffs can also be used. Suitable toner pigments include, for example, carbon black; phthalocyanine pigments; quinacridone pigments; azo pigments; rhodamine pigments; magnetites; and imidazolone pigments.

The colouring agents will generally provide one of four basic colours: black, yellow, cyan, and magenta, although more than four basic colours may be used in certain systems.

Specific examples of suitable colouring agents include:

Toner Yellow HG, a benzimidazolone pigment from Clariant

Irgalite Blue GLG, a cyan pigment from Ciba

Toner Magenta EO2, a quinacridone pigment from Clariant

Printex 70, a black pigment from Degussa

A charge-control agent, if used may be a positive or negative charge-control agent. Examples of positive charge-control agents include Nigrosine and onium salts. Examples of negative charge-control agents include metal azo complexes, salicylates and sulphonates. Alkyl pyridinium halides may also be mentioned. Suitable charge-control agents are commercially available, for example, NCA LP 2243 from Clariant. It is an advantageous feature of the present invention, however, that it is in general not necessary to incorporate a charge-control agent as a pre-extrusion ingredient. Thus, in the practice of the invention, both charge character and fluidity properties are controlled primarily by means of the post-blended additive as defined hereinbefore.

Base toner compositions for use according to the Invention (i.e., compositions before the incorporation of any post-additive) are generally prepared in known manner by intimately mixing the Ingredients, for example in an extruder, at a temperature above the softening point of the resin. The extrudate is then milled, for example, jet-milled, to produce a relatively fine particle size distribution, from which ultrafine particles (typically <3 microns) are removed. Non-extruder-based production processes, for example, involving emulsion or suspension polymerisation, may also come into consideration.

The use of a wax as a pre-extrusion ingredient in toner compositions of the invention may be advantageous, for example, In providing lubrication in printing machines and also in increasing the rub-resistance of, for example, labels printed using the compositions. The proportion-of wax may, for example, be in the range of from 0 to 5% by weight, based on the total weight of the composition without post-blended additive.

In general, the toner composition will have a particle size distribution such that $d(v)_{90}$ is ≦30 microns or ≦20 microns, more usually ≦15 microns, for example from 10 to 15 microns, with a mean particle size of from 5 to 8 microns.

Particle size distribution data is usually obtained using equipment such as the Coulter Counter Multisizer II or the Mastersizer X laser light-scattering device from Malvern Instruments. The data is expressed partly in volume percentiles $d(v)_X$, where X is the percentage of the total volume of the particles that lies below the stated particle size d. Thus, for Instance, d(v)50 is the median particle size of the sample.

The present invention also provides a developer composition which comprises a toner composition, with a post-blended additive according to the invention, in admixture with carrier particles.

The carrier particles will in general be conductive and may comprise, for example, a ferrite (nickel zinc, copper zinc, or manganese), iron powder or magnetite powder.

Typically, the particle size distribution of the carrier particles will be such that $d(v)_{90}$ is 50, 60, 70, 80, 90 or 100 microns.

The carrier particles may be coated or uncoated. Preferably, however, the particles are coated with a material which assists in tribo-charging of the toner, acts as a protective coating to prolong the active life of the carrier and/or alters the resistivity (conductivity) of the carrier. For positive-charging applications the coating materials are typically fluoropolymer-based, and for negative-charging applications the coating materials are typically acrylic materials or silicones. Suitable carrier materials are commercially available.

The charge distribution in tribo-charged toner compositions of the invention may be assessed using a charge spectrometer such as the Espart by Hosokawa.

Toner and developer compositions according to the invention may in principle be used in any electrostatic copying or printing process, such as xerography, electrophotography, electrography and digital printing. Matching of the toner/developer compositions to particular end uses is facilitated by using post-additive technology, in accordance with the invention, for controlling both fluidity and tribo-charging characteristics.

The invention is also applicable to other image development processes, for example, magnetography, where control of fluidity and charge control is required. Ionography may also be mentioned.

Application of the toner composition to the substrate may be by any "dry" powder development method as described, for example, in EP 0 601 235 A1.

Both "contact" and "non-contact" fusing processes come into consideration, and reference is again made to EP 0 601 235 A1 for further information in this respect.

It will be appreciated that the present invention is not concerned with solvent- or liquid-containing systems, because the presence of solvent or liquid would inherently nullify the principal objectives of the Invention, namely the achievement of adequate fluidity of fine toner powder compositions, and control of the electrostatic charge generated on such powder by tribostatic interaction.

The following Examples illustrate the invention:

| 1) Base toner compositions | |
|---|---|
| 1.1) Yellow toner formulation | |
| Polyester resin (P382-ES HMW, Reichold) | 1800 g |
| Pigment (Toner Yellow HG 107 587, Clariant | 200 g |
| | 2000 g |
| 1.2) Cyan toner formulation | |
| Polyester resin (P382-ES HMW) | 1900 g |
| Pigment (Irgalite Blue GLG, Ciba) | 100 g |
| | 2000 g |
| 1.3) Magenta toner formulation | |
| Polyester resin (P382-ES HMW) | 1800 g |
| Pigment (Toner Magenta EO2 Clariant) | 200 g |
| | 2000 g |
| 1.4) Black toner formulation | |
| Polyester resin (P382-ES HMW) | 1900 g |
| Pigment (printex 70, Degussa) | 100 g |
| | 2000 g |
| 1.5) Cyan toner formulation* | |
| Polyester resin (P382-ES HMW) | 1860 g |
| Pigment (Irgalite Blue GLG, Ciba) | 100 g |
| Negative charge control agent (NCA LP 2243, Clariant) | 40 g |
| | 2000 g |
| 1.6) Cyan toner formulation | |
| Styrene/methacrylate copolymer | 1900 g |
| Pigment (Irgalite Blue GLG, Ciba) | 100 g |
| | 2000 g |

[*including charge-control agent added pre-extrusion]

1.7) Preparation of Base Toner Compositions

For each of the base toner formulations given above, the ingredients are first blended in a Kenwood Chef blender for 5 minutes, and the blended formulation is then fed into a twin-screw extruder (Werner Pfleiderer) operating at 110° C. The extrudate is rolled flat on a chilled plate and broken into chip form (ca. 1 cm mesh). The chips are ground in a jet mill (Hosokawa Micron) to produce a base toner composition having the following particle size distribution (determined using a Coulter Counter Multisizer II):

| | |
|---|---|
| $d(v)_{90}$ | <12 microns |
| mean | 5 microns |

The jet milled composition is classified to reduce the content of ultrafine particles (<3 microns), and the particle size distribution of the composition after classification is as follows:

| | |
|---|---|
| $d(v)_{90}$ | 13.4 microns |
| $d(v)_{10}$ | 6 microns |

| 2) Three-component post-blended additives | |
|---|---|
| 2.1) Additive for Yellow, Magenta and Black toner compositions | |
| Aluminium hydroxide (Martinal OL 107C) | 33.75 g |
| Aluminium oxide (Degussa) | 11.25 g |
| Hydrophobic silica (Wacker HDK H3004) | 5.00 g |
| 2.2) Additive for Cyan base toner compositions | |
| Aluminium hydroxide (OL 107C) | 26 g |
| Aluminium oxide (Degussa) | 14 g |
| Hydrophobic silica (HDK H3004) | 10 g |

2.3) Preparation of Post-blended Additives

For each of the additive formulations given above, the aluminium hydroxide and aluminium oxide are pre-mixed in a Moulinex liquidiser/blender for 3 minutes. The silica is then added and the whole is then mixed for a further 3 minutes.

3) Preparation of Toner Compositions

In the case of each of the base toner compositions prepared as described at 1.7) above, 2 g of the appropriate post-additive is added to 100.g of the composition (i.e. in a proportion of 2% by weight) and the whole is tumbled in a Turbula T2 mixer for 1 hour. The resulting composition incorporating post-blended additive is then sieved through a sieve of 44 micron mesh.

4) Preparation of Developer 4.1) Acrylic-coated Magnetite Carrier

In each case, to form a developer composition, 5% by weight of the toner composition prepared as described at 3) above is tumble-mixed with acrylic-coated magnetite carrier beads in a Turbula T2A mixer for 1 hour.

4.2) Silicone-coated Magnetite Carrier

Analogously to Example 4.1), a toner composition made from the yellow toner formulation 1.1) and the appropriate post-additive 2.1) is tumble-mixed with a silicone coated magnetite carrier to a concentration of 5% by weight based on the weight of the carrier.

4.3) Silicone-coated Copper/zinc Ferrite Carrier

Analogously to Example 4.1), a toner composition made from the yellow toner formulation 1.1) and the appropriate post-additive 2.1) is tumble-mixed with a silicone-coated copper/zinc ferrite carrier to a concentration of 4% by weight based on the weight of the carrier.

5) Trial Printing

Trial printing is carried out using a Nilpeter DL-3300 digital colour printing machine. Each toner composition gives a clear and even test print with no contamination of the non-printed areas.

6) Dependence of the Charge Distribution on Additive Concentration

A series of developer compositions, each containing a different proportion of post-additive in accordance with the invention, is prepared analogously to the process described at 3) and 4.1) above.

The toner base formulation is as follows:

| | |
|---|---|
| Polyester resin (P 382-ES HMW, Reichold) | 900 g |
| Pigment (Toner Yellow HG 107587, Clariant) | 100 g |
| $D(v)_{90}$ is <13 microns | |

The composition of the post-blended additive is as given at 2.1) above.

The post-blended additive is mixed with 100 g samples of the base toner composition at concentrations of 1% w/w, 2% w/w, 3% w/w and 5% w/w, and in each case tumble-mixed and sieved as described at 3) above.

0.5 g of each of the resulting toner compositions is tumble-mixed in a Turbula T2 mixer, at 44 cycles per minute, with 9.5 g of acrylic-coated magnetite carrier beads and the charge distribution of the resulting charged composition is in each case assessed using an Espart charge spectrometer (Hosokawa).

Very little variation in charge is observed over the whole 1%-5% post-additive concentration range. In addition, the charge distribution curve is narrow with a single peak at each additive concentration.

In order to provide a basis for comparison, the experiment described above is repeated using, instead of the three-component post-blended additive in accordance with the invention, post-additions of hydrophobic silica alone, at concentrations of 1%, 2%, 3% and 5% by weight. After tribo-charging in the final step of tumble-mixing the toner compositions with the carrier particles, it is found firstly, by charge spectrometric examination, that the toner negative charge increases significantly with increasing concentration of hydrophobic silica. Also, it is found that the charge distribution curve becomes progressively much broader as the silica concentration is increased.

7) Time Dependence of Toner Charge 2 g of the three-component post-blended additive in accordance with the invention as described at 6) is tumble-mixed with 100 g of the base toner composition, also as described at 6), in accordance with the process described at 3) above, and the resulting toner composition is sieved through a 44-micron mesh sieve.

2 g of the sieved composition is tumble-mixed with 38 g of acrylic-coated magnetite carrier beads for 30 minutes. The charge distribution of the resulting tribo-charged composition is assessed.

The composition is then stored in an airtight bottle for 30 days, after which it is again tumble-mixed for 30 minutes under the same conditions as before. Charge spectrometric examination shows that the charge remains constant over the 30-day period.

In order to provide a basis for comparison, the experiment described above is repeated using a 2% by weight post-addition of hydrophobic silica alone instead of the three-component post-blended additive in accordance with the invention. After the 30-day storage period and subsequent tumble-mixing as before, it is found that the charge on the toner composition has fallen significantly.

8) Fluidity of Toner Compositions

Hausner Ratios/Drop Cone Analysis

The Hausner ratio and drop cone angle of a powder provide a measure of the fluidity of the powder.

In order to determine the Hausner ratio of a powder, the powder under test is first sieved through a 100-micron mesh sieve and allowed to fall into a cup placed 13 cm below the sieve. The cup is weighed when full of powder (level upper surface of powder mass) to give a value for the weight of the aerated powder.

While tapping the cup 120 times at a rate of 1 tap/second more powder is then added so as to maintain the cup full. The full cup is then weighed again to give a value for the weight of the tapped powder.

The Hausner ratio, HR. is then given by.

HR=weight of a tapped powder/weight of aerated powder

The higher the Hausner ratio, the lower the fluidity of the powder.

In order to determine the drop cone angle of a powder, the powder under test is allowed to fall from a sieve and through a funnel placed 7 cm above a circular platform 8 cm in diameter. The process is continued until the cone formed by the falling powder covers the whole surface of the platform. The angle of the cone is then the "drop angle" of the powder. The smaller the cone angle, the greater the fluidity of the powder.

In order to demonstrate the effect on the fluidity of a toner composition caused by a post-additive according to the invention, the Hausner ratios and drop cone angles are determined as above, in a Hosokawa powder tester, for three toner compositions, A to C, each made from the cyan toner formulation given at 1.2) above.

Test composition A has a 2% by weight addition of a post-additive according to the invention, as given at 2.2) above.

In order to provide a basis for comparison, test toner composition B has a 2% by weight addition of a silica post-additive (R972 Wacker).

Each of toner compositions A and B is prepared as described at 3) above.

To provide a further basis for comparison, test toner composition C has no post-additive addition.

The results obtained are as follows:

| Test composition | Hausner ratio | Drop cone angle (degrees) |
|---|---|---|
| A (invention) | 1.43 | 25.9 |
| B (comparison) | 1.59 | 42.8 |
| C (comparison) | 1.91 | 50.9 |

The superior fluidity obtained with the use of a post-additive according to the invention is dearly evident.

| 9) Two-component additives | |
|---|---|
| 9.1) Two-component additive I | |
| Aluminium hydroxide (Martinal OL 107 C) | 37.5 g |
| Aluminium oxide (Degussa) | 12.5 g |
| 9.2) Two component additive II | |
| Aluminium hydroxide (Martinal OL 107 C) | 27.5 g |
| Aluminium oxide (Degussa) | 22.5 g |

9.3) Preparation of Two-component Post-blended Additive

For each of the additive formulations I and II, the aluminium hydroxide and aluminium oxide are mixed in a Moulinex liquidiser/blender for 3 minutes.

9.4) Preparation of Toner Compositions

Using additive formulations I and II, toner compositions are prepared as described at 3) above, using the base toner compositions described at 1) above.

9.5) Preparation of Developer

In each case, to form a developer composition, 0.5 g of the toner composition prepared as described at 9.4) above is tumble-mixed with 9.5 g acrylic-coated magnetite carrier particles In a Turbula T2 mixer at 44 cycles per minute for 30 minutes.

The charge distribution of the resulting charged composition is in each case assessed using an Espart charge spectrometer (Hosokawa).

In each case, the charge distribution curve is narrow and shows a negative charge. The compositions containing the two-component additive I show a lower negative charge than the corresponding compositions containing the two component additive II.

This result shows that the magnitude of the charge and the charge distribution width can be modified by compositional changes in the two-component additive alone, without the need for a third tribo charging additive.

9.6) Effect on Gloss—Toner Compositions

The effect on gloss resulting from the use of post-additives I and II according to the invention, described at 9.1) and 9.2) above, as compared with the use of hydrophobic silica as the sole post-additive, is assessed as follows:

For reference purposes, the test is also carried out using the basic toner with no post-additive.

In each case, the post-additive under test is mixed with the yellow base toner composition described in Example 6) above, and tumble-mixed for 30 minutes. The resulting composition is in each case applied to an aluminium panel (10 cm×7 cm×0.06 cm) by means of an electrostatic spray gun (GEMA).

The panel is then placed with the toner face-up on a hot-plate maintained at 200° C. After heating for 2 minutes, the panel is removed and allowed to cool. The 60° gloss of the resulting fused toner film is measured using a hand-held gloss meter (Sheen Instruments) and the results obtained are as follows:

| Post-additive: | 60° gloss: |
|---|---|
| None (reference) | 93 |
| 1% additive I | 93 |
| 5% additive I | 93 |
| 1% additive II | 93 |
| 5% additive II | 91 |
| 1% silica (comparison) | 60.4 |
| 2% silica | 20.3 |
| 3% silica | 1.5* |

*Toner fused but very little coalescence to form film.

The results show that the post-additives according to the invention have substantially no effect on the gloss of the fused toner film.

In comparison, the silica post-additive has a severe effect, causing matting even at low concentration and leading to non-coalescence of toner particles at higher concentration.

The invention claimed is:

1. A toner composition having a post-blended particulate additive which comprises aluminium oxide and aluminium hydroxide, wherein the post-blended particulate additive further comprises a tribo-charging additive which, upon tribo-charging of the toner particulates, shifts the charge distribution in either the positive or negative direction as compared with the charge distribution in the absence of the additive.

2. A toner composition as claimed in claim 1, wherein the total amount of aluminium oxide and aluminium hydroxide is in the range of from 0.1 to 25% by weight, based on the weight of the toner composition without the additive.

3. A toner composition as claimed in claim 1, wherein the ratio by weight of aluminium hydroxide to aluminium oxide in the post-blended additive is in the range of from 1:99 to 99:1.

4. A toner composition as claimed in claim 1, wherein the particle size of each of the aluminium oxide and the aluminum hydroxide is in the range of from 0.01 to 10 microns.

5. A toner composition as claimed in claim 4, wherein the particle size of the aluminum oxide is ≦0.2 microns.

6. A toner composition as claimed in claim 4, wherein the particle size of the aluminum hydroxide is from 0.9 to 1.3 microns.

7. A toner composition as claimed in claim 1, wherein the tribo-charging additive comprises a silica.

8. A toner composition as claimed in claim 1, wherein the tribo-charging additive comprises a wax.

9. A toner composition as claimed in claim 1, wherein the particle size of the tribo-charging additive is in the range from 0.01 to 10 microns.

10. A toner composition as claimed in claim 1, wherein the total amount of the post-blended particulate additive is in the range from 0.1 to 25% by weight.

11. A toner composition as claimed in claim 1, wherein the tribo-charging additive constitutes from 1 to 99% by weight of the post-blended particulate additive.

12. A toner composition as claimed in claim 1, wherein the toner composition comprises particles consisting of a resin, a colouring agent, optionally a charge-control agent, and optionally a wax.

13. A toner composition as claimed in claim 12, wherein the proportion of resin in the composition is in the range of from 40 to 99% by weight, based on the total weight of the composition without post-blended additive.

14. A toner composition as claimed in claim 12, wherein the proportion of colouring agent in the composition is in the range of 1 to 60% by weight, based on the total weight of the composition without post-blended additive.

15. A toner composition as claimed in claim 12, wherein the proportion of charge-control agent incorporated in the toner particles is from 0 to 10% by weight, based on the total weight of the composition without post-blended additive.

16. A toner composition as claimed in claim 12, wherein the proportion of wax incorporated in the toner particles is from 0 to 5% by weight, based on the total weight of the composition without post-blended additive.

17. A developer composition which comprises a toner composition as claimed in claim 1, in admixture with carrier particles.

18. A developer composition as claimed in claim 17, wherein the carrier particles are formed of a conductive material.

19. A developer composition as claimed in claim 18, wherein the carrier particles are formed of a ferrite iron powder or magnetite.

20. A developer composition as claimed in claim 17, wherein $d(v)_{90}$ for the carrier particles is 50, 60, 70, 80, 90 or 100 microns.

21. An electrostatic copying or printing process comprising application of the toner composition of claim 1.

22. An electrostatic copying or printing process comprising application of the developer composition of claim 17.

23. A toner composition as claimed in claim 7, wherein the tribo-charging additive comprises a hydrophobic silica or a wax coated silica.

24. A toner composition as claimed in claim 1, wherein the total amount of aluminium oxide and aluminium hydroxide is in the range of from 1 to 15% by weight, based on the weight of the toner composition without the additive.

25. A toner composition as claimed in claim 1, wherein the total amount of aluminium oxide and aluminium hydroxide is ≦10% by weight, based on the weight of the toner composition without the additive.

26. A toner composition as claimed in claim 1, wherein the total amount of aluminium oxide and aluminium hydroxide is in the range of from 2 to 4% by weight, based on the weight of the toner composition without the additive.

27. A toner composition as claimed in claim 1, wherein the ratio by weight of aluminium hydroxide to aluminium oxide in the post-blended additive is in the range of from 50:50 to 99:1.

28. A toner composition as claimed in claim 1, wherein the ratio by weight of aluminium hydroxide to aluminium oxide in the post-blended additive is in the range of from 50:50 to 80:20.

29. A toner composition as claimed in claim 1, wherein the total amount of the post-blended particulate additive is ≦10% by weight.

30. A toner composition as claimed in claim 1, wherein the total amount of the post-blended particulate additive is in the range from 2 to 4% by weight.

31. A toner composition as claimed in claim 1, wherein the tribo-charging additive constitutes from 1 to 70% by weight of the total post-blended particulate additive.

32. A toner composition as claimed in claim 1, wherein the tribo-charging additive constitutes from 15 to 25% by weight of the total post-blended particulate additive.

33. A toner composition having a post-blended particulate additive which comprises aluminium oxide and aluminium hydroxide:

i) the toner composition, without the post-blended additive, has a mean particle size in the range of from 5 to 8 microns;

ii) the toner composition, without the post-blended additive, has a $d(v)_{90}$≦15 microns;

iii) the aluminium oxide has a particle size ≦0.2 microns; and iv) the aluminium hydroxide has particle size of from 0.9 to 1.3 microns.

34. A toner composition as claimed in claim 1, wherein the toner composition has toner particles having particle sizes greater than that of each of the aluminium oxide and aluminium hydroxide in the post-blended particulate additive.

35. A toner composition as claimed in claim 1, wherein i) the toner composition, without the post-blended additive, has a mean particle size in the range of from 5 to 8 microns;

ii) the toner composition, without the post-blended additive, have a $d(v)_{90}$ of ≦15 microns; and iii) the post-blended aluminium oxide and aluminium hydroxide has a particle size in the range from 0.1 to 10 microns.

36. A toner composition as claimed in claim 1, wherein the toner composition has toner particles having particle sizes greater than that of each of the aluminium oxide, aluminium hydroxide and the tribo-charging additive in the post-blended particulate additive.

37. A toner composition as claimed in claim 1, wherein i) the toner composition, without the post-blended additive, has a mean particle size in the range of from 5 to 8 microns;

ii) the toner composition, without the post-blended additive, have a $d(v)_{90}$ of ≦15 microns; and iii) each component of the post-blended additive has a particle size in the range from 0.1 to 10 microns.

38. A toner composition according to claim 37, wherein the tribo-charging additive comprises a silica.

39. A toner composition according to claim 38, wherein the tribo-charging additive comprises a hydrophobic silica.

40. A toner composition as claimed in claim 12, wherein the proportion of resin in the composition is in the range of from 60 to 99% by weight, based on the total weight of the composition without post-blended additive.

41. A toner composition as claimed in claim 12, wherein the proportion of resin in the composition is in the range of from 80 to 99% by weight, based on the total weight of the composition without post-blended additive.

* * * * *

UNITED STATES PATENT AND TRADEMARK OFFICE

CERTIFICATE OF CORRECTION

PATENT NO. : 7,601,472 B2
APPLICATION NO. : 10/525678
DATED : October 13, 2009
INVENTOR(S) : Kevin Jeffrey Kittle It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 759 days.

Signed and Sealed this

Fifth Day of October, 2010

David J. Kappos

David J. Kappos
*Director of the United States Patent and Trademark Office*